United States Patent [19]

Schumacher

[11] Patent Number: 4,622,760

[45] Date of Patent: Nov. 18, 1986

[54] APPARATUS FOR DESOLVENTIZING AND DRYING SOLVENT-CONTAINING RESIDUE MEAL

[76] Inventor: Heinz O. Schumacher, Höperfeld 26, D-2050 Hamburg 80, Fed. Rep. of Germany

[21] Appl. No.: 769,766

[22] Filed: Aug. 27, 1985

Related U.S. Application Data

[62] Division of Ser. No. 590,741, Mar. 19, 1984, abandoned.

[30] Foreign Application Priority Data

Mar. 31, 1983 [EP] European Pat. Off. ..... 83103235.4

[51] Int. Cl.[4] ..... F26B 19/00; F26B 17/12

[52] U.S. Cl. ..... 34/65; 34/86; 34/171; 426/489

[58] Field of Search ..... 34/65, 86, 171; 426/489, 430, 459, 511, 478

[56] References Cited

U.S. PATENT DOCUMENTS

| | | | |
|---|---|---|---|
| 2,585,793 | 2/1952 | Kruse | 99/98 |
| 2,639,973 | 5/1953 | Fritz | 34/171 |
| 2,676,668 | 4/1954 | Lindsay | 34/171 |
| 2,776,894 | 1/1957 | Kruse | 99/98 |
| 3,126,285 | 3/1964 | Lippold | 426/459 |
| 4,332,092 | 6/1982 | Hansotte | 34/86 |
| 4,523,388 | 6/1985 | Cuel | 34/86 |

FOREIGN PATENT DOCUMENTS

| | | |
|---|---|---|
| 658037 | 1/1965 | Belgium . |
| 0070496 | 1/1983 | European Pat. Off. . |
| 0077436 | 4/1983 | European Pat. Off. . |
| 2348734 | 4/1975 | Fed. Rep. of Germany . |
| 2608712 | 1/1977 | Fed. Rep. of Germany . |
| 1438847 | 6/1976 | United Kingdom . |

OTHER PUBLICATIONS

Von H. Schumacher, "Der Desolventizer-Toaster--Trockner-Kuhler (TTK), ein neues Verfahren bei der Verarbeitung von Olsaaten", Fette-Seifen-Anstrichmittel, 1976, p. 4.

*Primary Examiner*—George Yeung
*Attorney, Agent, or Firm*—Lane and Aitken

[57] ABSTRACT

In the desolventizing of solvent-containing residues which are obtained in the extraction from vegetable, oil and fat-bearing raw materials with organic solvents and from which the so-called miscella containing oil and/or fat has been separated, the desolventization proper by direct action of a desolventizing agent, particularly steam, is relieved by interposing before the desolventization proper a pre-desolventization with indirect heat transfer, particularly indirect steam heating, and thereby the energy input of the entire system is reduced considerably.

Moreover, the drying and cooling of the now solvent-free residue, which follows the desolventizing, can take place in a single, combined stage, whereby further relief of the volume of apparatus as well as the energy input is achieved.

3 Claims, 3 Drawing Figures

APPARATUS FOR DESOLVENTIZING AND DRYING SOLVENT-CONTAINING RESIDUE MEAL

This application is a division of application Ser. No. 590,741 filed Mar. 19, 1984, now abandoned.

BACKGROUND OF THE INVENTION

In the extraction from vegetable, oil and fat-bearing raw materials, such as oil plants or fruits and oil seeds, with organic, especially polar solvents for the purpose of producing oils, fats, and phosphatides (lecithin), there is obtained, on the one hand, the solution designated as miscella comprising the oils, fats, and phosphatides in solution in the solvents and, on the other hand, a residue free of oil and/or fat or having only a low oil and/or fat content, i.e. the so-called meal.

This residue, which may, for example, still have a residual content of oil of up to 0.5% by weight and contain up to 30% by weight of solvent, after being separated from the miscella by pressing or screening, is treated in a predominantly continuous process with steam or steam-containing fluids and thereby freed from solvent to an optimum degree.

The percentage of solvent in the solvent-wet residue, the meal, is of course dependent on the nature of the solvent or extractant, on the raw material, on the extraction process with its specific process parameters, etc. and may therefore vary within certain limits. However, it is necessary, and that not only for reasons of process economy, to provide for separation of the solvent from the meal and optimum recovery of the solvent; moreover, the meal itself, which is mainly processed to be used as feedstuff for animals and for food products, can only then be utilized if it is passed on for processing in a practically solvent-free condition.

The solvents predominantly used by the respective industry as extractants for oil plants or fruits and oil seeds are aliphatic hydrocarbons, particularly commercial hexane (n-hexane). This hexane has a boiling range of about 63° to 70° C. (145° to 158° F.)—depending on the structure.

It is understood that, depending on the raw material and the extraction process, there are used also other extractants, such as pentanes, heptanes as well as the corresponding iso-compounds or mixtures thereof. However, especially in the production of oil and fat from soy beans, cotton seed, beechnuts, linseed, rape, sesame, sunflowers, etc., the commercial hexane of the above specification has proved to be particularly suitable, so that the invention is described, by way of example, by reference to the extraction from soy material by means of hexane.

As the commercial solvents like hexane etc. are designated by the respective industry as benzenes, the improved process provided by apparatus according to the invention for driving out hexane from the residue of extraction will be designated in the following quite generally and in accordance with the technical terminology as "debenzenizing" (or, rather, "desolventizing", which is the more appropriate term in the English language).

Suitable processes and apparatus for debenzenizing or desolventizing residues of the extraction from oil seeds or oil plants or fruits, the so-called meal, have long been known. Apparatus or devices of this type are offered by the respective industry under the terms toaster, desolventizer, drier or steam cooker in many more or less efficient constructions. Thereby, the meal is freed from extractant with hot air, steam or other suitable fluids in predominantly continuous operation and, at the same time, the extractant is recovered.

Thus, U.S. Pat. No. 2,585,793 describes a toaster developed particularly for extracted soybean flakes wherein the desolventizing is effected by the introduction of direct steam, in the upper region of a multistage system. In the apparatus according to U.S. Pat. No. 2,776,894, the uppermost of a multi-bottom system is provided with steam outlet openings so that the introduced material in the uppermost compartment is directly exposed to the steam. According to German Pat. No. 26 08 712, the direct steam is introduced through the lowermost bottom of the vessel, which is in the form of a perforated or sieve bottom, and is conducted, through likewise perforated compartment bottoms, in opposition to the material, from bottom to top, throughout the entire height of the vessel.

From the publication "Fette-Seifen-Anstrichmittel", 1976, No. 2, pages 56 et seq., there is known "toaster", which is meanwhile used all over the world, in which the solvent-wet meal coming continuously from the extraction, in the uppermost compartment of a multi-compartment system, is treated with direct steam (water vapor), the steam being introduced laterally into the compartment bottom having the form of a double bottom and uniformly distributed, through a plurality of perforations, over the entire cross-section of the bottom. A portion of the steam condenses in the meal, a further portion issues therefrom, together with the solvent, i.e. the benzene, as vapors, and is passed on, as condensate, to a benzene-water separator.

The double bottom of the uppermost compartment—and of each of the further compartments—includes a rotary gate valve through which the desolventized meal continuously falls into the compartment or stage lying below that, the so-called drying stage. By the speed of rotation of the gate valve(s) it is possible to adjust a particular level of material in the individual compartments or stages. The drying stage, which follows the desolventizing, is likewise downwardly defined by a perforated bottom constructed as a double bottom through which hot air for the drying of the meal containing condensate is introduced and uniformly distributed. The air is pressed through the perforated bottom into the meal by means of a ventilator and—laden with moisture—discharged laterally above the bed of meal. Eventually, in the lower stage, the meal is cooled, a ventilator sucking cold air through the meal through a simple perforated bottom.

Regarding the construction, that "toaster-drier-cooler", briefly called "TTK", is a single apparatus, but, with regard to the process, this involves the interaction or the sequence of three operating stages because in each compartment the meal is subjected to a different treatment.

The TTK is especially advantageous economically in view of the low investment costs thereof because three otherwise independent processes with independent apparatus can be performed in a single vessel.

Moreover, due to the vertical succession of the processes, conveying elements, such as transporters, elevators, screw conveyors etc. are dispensed with.

The consumption of energy (steam, hot air, cooling air) is also considerably lower with the TTK compared to a system consisting of three separately operating plants, e.g. a separately operating desolventizer, a fluidized-bed drier connected thereto, and a tubular cooler or the like.

On the other hand, it has been found that especially in the case of TTK's of very large volume, as are used e.g. in the desolventizing of solvent-wet soybean meal, the consumption of electric energy is higher than with known classical desolventizing systems including cascade coolers, multipass driers etc.

Particularly the consumption of electric energy is determined in the TTK substantially by the work performed by the main shaft which carries agitator or rabble arms for each compartment of the multi-compartment system, said rabble arms moving through the meal to convey it uniformly over the compartment bottoms and to prevent the formation of channels due to the upwardly streaming gases (water vapor, hot air, cooling air).

In this connection, tests under service conditions have shown that the main load and consequently the greatest amount of electric energy is involved in the region of desolventizing and, thus, the moving or agitating of the solvent-wet meal, but not in the drying and cooling sector. It is obvious that the wet meal containing up to 30% and more hexane offers greater resistance to the agitator elements than does the material being only water-wet or being already dry. Naturally, electric energy is required also by the ventilators for the movement of hot air and cold air, but this consumption is out of all proportion to that of the drive shaft of the agitator elements in the region of desolventizing proper.

In order to reduce the energy consumption at the main agitator shaft of the TTK, in a further development of the latter, the desolventizing sector itself has been provided with further compartments and, thus, also, further bottoms as well as with rabble arms moving over said bottoms. Furthermore, the height-to-diameter ratio was improved in favor of the overall height, that means, the apparatus was made greater in length but smaller in diameter. Thereby it was made possible to install the bottoms in the desolventizing stage which is always located at the top.

Such a desolventizer-toaster (DT), which is also based on development work by the inventor, is described in EP-A-O 070 496.

In this apparatus, the steam, for desolventizing solvent-wet soybean meal, is introduced as direct steam at the lowest point, i.e. underneath the lowermost bottom of a multi-compartment system, and distributed through perforations. This apparatus is also provided with a central shaft through which the rabble arms are moved slightly above each perforated compartment bottom. The individual bottoms again may be in the form of double bottoms having a plurality of specially designed perforations by which a so-called spray effect is obtained. Thereby the aim is achieved to conduct the steam blown in to the lowermost region of the vertical apparatus on its way upwardly from compartment to compartment unhindered and to practically exclude the formatioh of steam channels.

By this relatively simple construction measure, i.e. by the subdividing of the desolventizing zone into several, particularly three to four compartments, each having an agitator element but all driven through a common shaft, as well as by the provision of a plurality of quite specifically designed perforations or openings in the compartment bottoms, particularly compartment double bottoms, for the passage of steam therethrough, it could be achieved that despite the increase in number of the agitator elements in the desolventizing stage and in spite of the extended path length of the steam streaming from the bottom to the top, the power required at the agitator shaft, with unchanged capacity of the plant, was reduced by 30 to 50%.

Of special importance is also the fact that this apparatus permits a solvent (hexane)/steam vapors temperature of 66° to 68° C. (15O.8° to 154.4° F.) without any losses in regard to the degree of desolventizing, i.e. the residual content of solvent in the meal and the general economy of the plant.

For this reduction of the temperature of the vapors of hexane and steam issuing from the desolventizer, from 72° to 78° C. (161.6° to 172.4° F.) or more, as usual hitherto, to 66° to 68° C. (150.8° to 154.4° F.) and partly less, has the result that the consumption of direct steam for driving out the hexane could be lowered from e.g. 160 to 170 kg per 1,000 kg of hexane-wet soybean meal (a hexane content of about 20%) at over 72° C. (161.6° F.) to slightly more than 150 kg per 1,000 kg of meal at 66° C. (150.8° F.). For present-day type large-scale industrial plants, this is a considerable cost reduction if, for example, several thousands of tons of soybean meal are to be desolventized within short periods of time.

It is assumed that it is particularly the channel formation of steam that is responsible for the higher consumption of steam in the desolventizing stages usual hitherto, without intermediate bottoms, for that additional steam quite certainly leaves the plant unused passing through the material and directly through the connection piece for the vapors.

Therefore, in spite of satisfactory functional performance, it was not always possible with one-stage desolventizers, also with TTK, to operate under conditions that were fully satisfactory economically (steam consumption, optimal expulsion of hexane, economical conduction of process in regard to time, etc.), also not at temperatures in the vapors of 70° C. (158° F.) and higher.

It has been found that even at such low temperatures in the vapors, after a short starting period only, residual hexane contents of 0.05% and over, partly even up to over 1.0%, were proved in the desolventized meal. However, such high hexane contents render the meal unfit for use on grounds of nutrition physiology.

Therefore, one was forced again to revert to conventional temperatures of vapors of over 72° C. (162° F.).

By the installation of a plurality of intermediate bottoms in the desolventizing stage in accordance with EP-A-O 070 496, a continuous redistribution of the upwardly streaming steam takes place from one intermediate bottom to the next, so that the latter is fully utilized practically without the formation of ineffective channels. Moreover, the condensation of steam within the meal is considerably reduced.

Further improvements in regard to operational economy are obtained by a new development devised by the inventor which is described in European Pat. Application No. 82 106 498.7 (Publication No. 0 077 436). In this development, superheated steam at temperatures of up to 215° C. (419° F.) is used. The condensation of steam within the meal is reduced again, which does not only result in reduced steam but also produces a meal having a lower moisture content.

This in turn results in considerable relief of the following drying unit.

The steam consumption is a decisive criterion for the evaluation of an economically conducted desolventization. Added to this are the consumption figures for the motive energy for moving the agitator elements over the compartment bottoms and—as a minor factor only—the motive energy for the fans for the provision of hot air and cooling air.

The moisture content (water content) of the meal increases in the course of the desolventization, the transfer of heat of evaporation to the hexane causing the steam itself to condense. Thus, for example, in the desolventizing of hexane-wet soybean meal, according to a typical evaporation-condensation process close to practical operating conditions, the water content in the meal in the final stage of desolventization rises from about 12% by weight at entry into the desolventization to about 22 to 23% by weight. On the other hand, in the case of soybean, a water content in the desolventized meal of over 17% by weight is quite desirable for reasons of optimal expulsion of hexane, as it is only in this way that the hexane content is reduced to a minimum and the desired increase in nutritional value of the meal is ensured.

This relatively high water content in the desolventized meal does of course require an increased energy input for the drying and this energy input, e.g. for hot air, may indeed be such as to jeopardize the efficiency of the desolventization and, consequently, of the whole oil production plant.

SUMMARY OF THE INVENTION

Therefore, it is an object of the invention to show a way whereby optimal expulsion of solvent (desolventization) from the meal can be reached with simultaneous reduction of the amount of condensed water that has to be driven out again in a following drier with high energy input.

According to the invention this object is achieved in that before the desolventizing proper by means of steam in a continuous system equipped with a plurality of compartments or stages there is provided a so-called predesolventizing with the use of indirect steam or another form of energy transferring heat indirectly.

It is true that in the pre-desolventizing with indirect heat transfer, too, steam is needed, namely, if it is carried out with indirect steam—it is, as stated above, also possible to use other forms of energy, such as electric energy—, but the condensate of indirect heat transfer by steam is obtained as free water which need not be removed from the meal by evaporation. Moreover, by the pre-desolventizing, the desolventizing proper with the use of direct steam—which cannot be dispensed with altogether for reasons of process technology and product quality—is relieved in regard to the time and, simultaneously, the energy required for driving the agitator shaft in the desolventizer (TTK, DT etc.) is further reduced and the possibility is offered either to reduce in size the drying and cooling units following the desolventizer or even to combine the drying and cooling means to form a single unit.

The latter is of paramount importance particularly for large-scale plants as, for example, in case of annual capacities of 1 million tons of meal it is not possible any more to cope with such throughputs in a single desolventizing system (TTK or DT) operating with direct steam only. By means of pre-desolventizing, particularly by indirect steam, existing desolventizers are not only relieved; also, there is now nothing in the way to operate technically economically also such units which are capable of handling amounts even greater than the above-mentioned 1 million tons of meal p.a., which has so far been the limit. Of decisive importance in this connection is the indirect heat transfer to the meal in the pre-desolventizing, i.e. without condensation of steam in the meal.

As a special result of such a measure must also be considered the generally improved utilization of energy which becomes perceptible e.g. in an average saving in steam for the desolventizing process of 50 kg and more per 1,000 kg of processed seed (soybean).

Although, as said above, other indirect heat transfer media may also be used in pre-desolventizing, indirect steam is preferred because it requires no additional supply facilities since it is abundantly available in an oil production plant.

Suitable as pre-desolventizers have proved to be particularly steam-heated screw conveyors, trough conveyors with agitator elements, paddle screws, rotary and tumbling driers etc. which are adapted for continuous operation and which must of course be equipped with the necessary discharging or outlet means and condensation means for the expelled solvent. Also, it may be of advantage to operate in a vacuum.

The amount of solvent to be expelled in the pre-desolventizing, particularly with indirect steam heating, e.g. hexane from soybean meal, is, on the average, between 20 and 70%, particularly between 40 and 60%, preferably 50% of the solvent present on the wet meal.

Such values can well be realized with a properly conducted pre-desolventization. Complete expulsion of the solvent by indirect heat transfer, that means, without subsequent desolventization by e.g. direct steam, is not advisable for reasons of quality of the meal.

By the pre-desolventizing it is not only possible to save energy, but it is also possible to combine the drying and cooling processes and thereby to reduce the volume of apparatus considerably. This is possible in principle e.g. in case of the use of a desolventizer as described in EP-A-O 070 496, which desolventizer goes back to the TTK according to "Fette-Seifen-Anstrichmittel" (loc. cit.). Of advantage is additionally the use of superheated steam according to European Patent Application No. 82 106 498.7.

The simultaneous drying and cooling can be achieved e.g. in that the cooling air (primary air) is caused to stream through the desolventized, but still warm meal while the outgoing air from the cooling, through a heat exchanger, warms up the cold fresh air for the drying (secondary air), without substantial additional expenditure for the warming of the secondary air, to the required temperature of e.g. 55° C. (131° F.) and over. This warm secondary air is blown in above the initially still water-moist meal bed being moved or agitated in the combined drying and cooling unit. It dries the material and is subsequently united with the cooling air likewise warmed up by the cooling process.

As the secondary air requires much less expenditure of energy (merely electric energy for the drive of a blower) and the amount of primary air is reduced by the circulation of the secondary air, there is not only required less electric energy altogether, there is also obtained a reduction in the volume of apparatus by the combination of the drying and cooling stages, the power input and the size of the blowers are reduced and, finally, by the above measures, also the time or rate of throughput of the meal, is reduced, that means, an overall increase in capacity of a plant is possible.

BRIEF DESCRIPTION OF THE DRAWINGS

In the following, the invention will be explained, by way of example, by reference to FIGS. 1 to 3.

DESCRIPTIONS OF THE PREFERRED EMBODIMENTS

Figure 1:
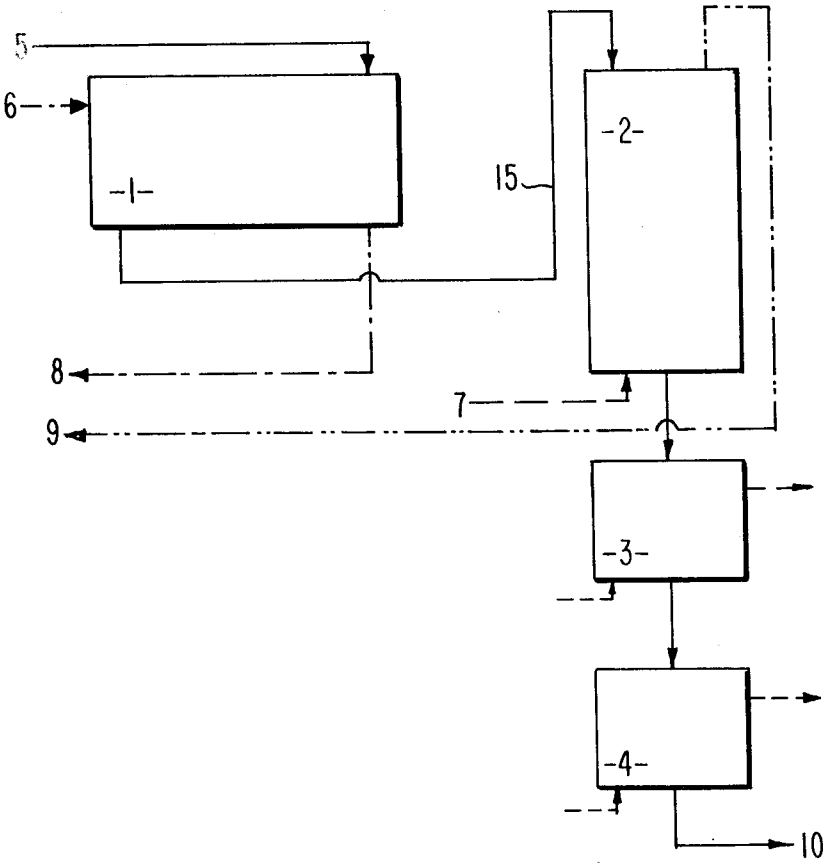
FIG. 1 shows in a block diagram a desolventizing system as usual heretofore, without the pre-desolventizing according to the invention.

According to FIG. 1, the starting material (5), e.g. soybean flakes, is treated in counter-current with the solvent (6), e.g. hexane, in an extractor (1) of any desired type. The design and operation of the extractor are not of decisive importance in the context of the invention, that means, any continuously operating extractors, particularly such with counter-current operation, may be used. Corresponding extractors are generally known, so that there is no need to mention them here.

The so-called miscella (8) containing about 20 to 40% oil (the rest being solvent and water) is continuously drawn off from the extractor (1) and passed on for further treatment (distillation, oil refining, possibly renewed solvent distillation etc.).

The hexane-wet soybean meal—here referred to by way of example for the whole process—passes from the extractor (1) through line (15) to the desolventization (2) which is generally in direct communication with the meal drying stage (3) and the meal cooling stage (4), but these three stages of meal processing do not necessarily form a unit.

The desolventizing in (2) is effected by means of steam, this steam, in accordance with the most recent findings, being preferably introduced, through line (7), at the bottom of desolventizer (2) which in many cases operates continuously. In this connection, the desolventizer described in EP-A-070 496 has proved to to be specially successful. This desolventizer comprises a mostly cylindrical vessel having several stages or compartments which are provided with downwardly defining or closing bottoms in the form of perforated or sieve plates including discharge means (rotary gate valves). Agitator elements are provided for each compartment on a common shaft to maintain the meal in constant motion. The meal enters the device above the uppermost stage and passes downwardly by gravity to be passed on further—again through a rotary gate valve—into the drying and cooling zones.

During this movement of the meal, steam is caused to stream in opposition thereto, from the lowermost compartment bottom, and, in the course of this, the steam, by a particularly advantageous construction of the intermediate bottoms, is constantly redistributed so that any channel formation is precluded and optimal desolventizing is attained. As stated above, a portion of the steam condenses in this process and thereby moistens the meal.

It should be noted here that according to a development of the desolventizer described in European Patent Application No. 82 106 498.7, superheated direct steam results in a specially high energy saving in desolventization.

As is shown in FIG. 1, the vapors of desolventization consisting of steam and hexane vapor are also passed on for processing, i.e. separation of the water from the hexane and, if necessary, distillation of the latter before the hexane is returned to the extraction.

For the sake of good order, it is pointed out here that also the desolventizer that has become known as "TTK", which combines desolventizing, drying and cooling in one vessel, has found general acceptance.

Independent of the type of desolventizer (2), the meal being free from hexane but instead containing a higher proportion of condensate, in the drying stage (3), is largely freed from water—by means of warm air or hot air—and subsequently, in (4), cooled with cold air to ambient temperature. Via (10), the hexane-free, dry and cooled meal is passed on for further utilization.

Figure 2:
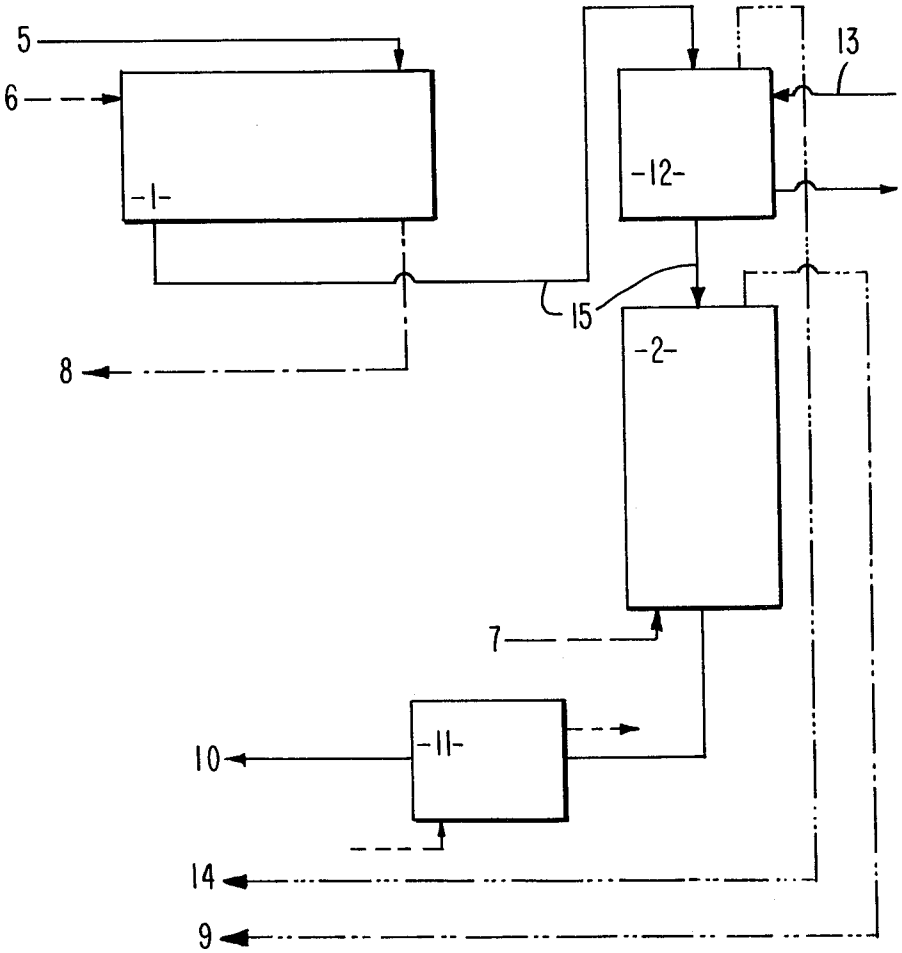
FIG. 2 shows the setup of a desolventizing system including the pre-desolventizing according to the invention.

Now, in accordance with the invention, as shown in FIG. 2, a pre-desolventizing stage (12) is provided before the desolventization (2) proper. This has the result that up to 70%, possibly even more, of the hexane contained in the hexane-wet meal is driven out. The pre-desolventization—contrary to the desolventization proper or main desolventization—operates with indirect heat transfer, particularly with indirect steam, whereby the water content in the meal is not increased.

This does not cause any change in the extraction system (1,5,6,8,15). The pre-desolventization is inserted directly into the path of transportation between the extractor (1) and the desolventizer (2) and may, e.g. as a steam-heated screw conveyor, effect the transportation through the conduit (15). The solvent—i.e., in the specific case, hexane—that has been been driven out in the pre-desolventizing stage (12) is passed on—like the vapors (9) issuing from the desolventizer—, via (14), for regeneration of the solvent.

Of advantage is also the use of a main desolventizer (2) of a design similar to that of the apparatus according to EP-A-O 070 496 or European Patent Application No. 82 106 498.7.

From the desolventization proper(2), with direct steam action (7), the water-containing meal passes to the drying and cooling stages which either function as isolated units (3,4) according to FIG. 1 or follow the desolventizer (2) as a combined drying and cooling stage (11).

Of special importance in this connection is a development according to the invention whereby the combined drying and cooling unit (11) is in direct connection with the desolventizer as a unitary structure.

Figure 3:
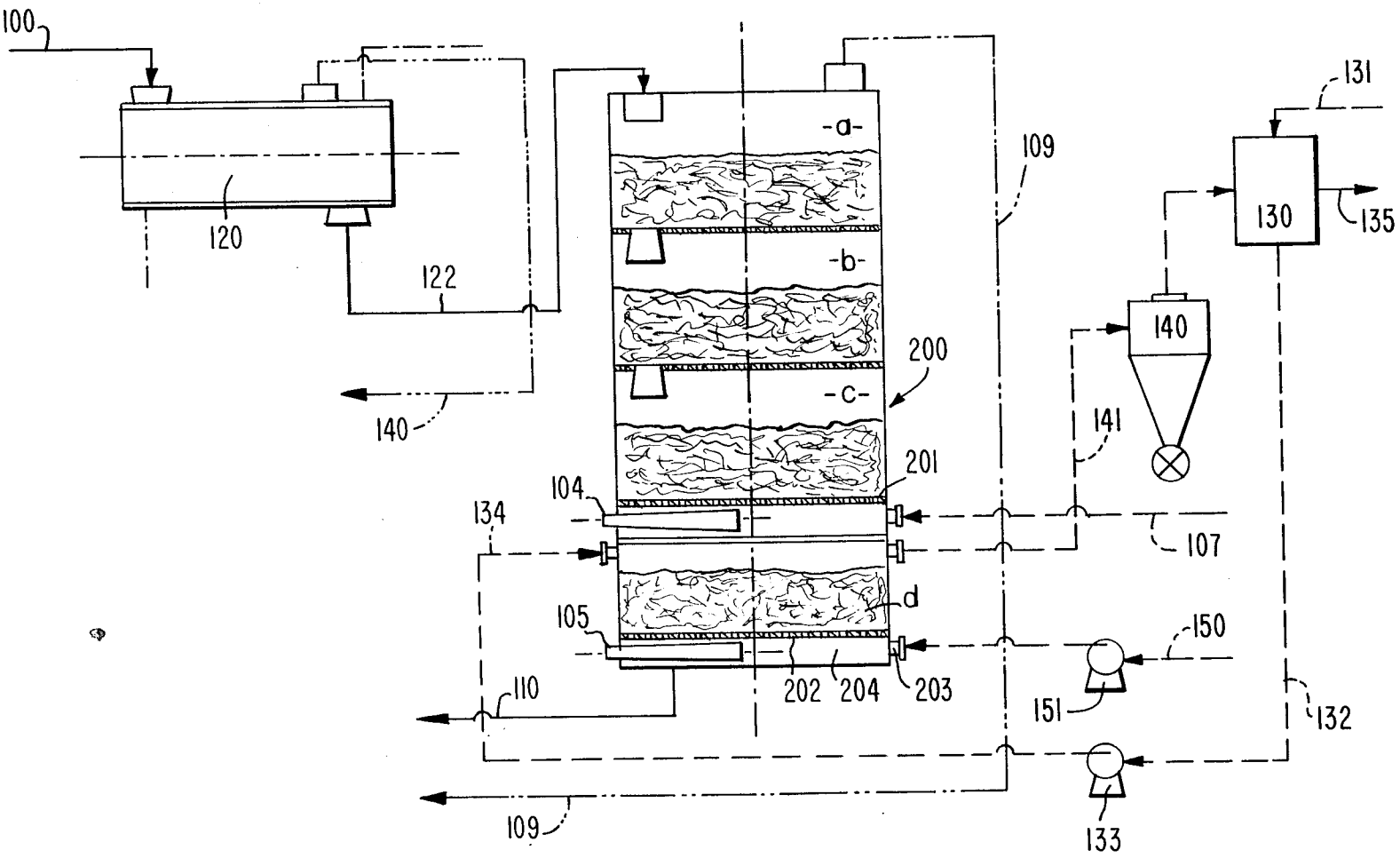
FIG. 3 shows the system according to FIG. 2, but with an additional combination of drying and cooling stages, also in accordance with the invention.

Such a plant and its operational setup are shown in FIG. 3.

Shown in block diagram is a plant or system which is provided, in accordance with the invention, with a pre-desolventizing stage and which is also equipped with a combined drying and cooling unit, said drying and cooling unit in turn forming a unit with the desolventization proper or main desolventization, so that drying and cooling are effected in one stage of operation.

The hexane-wet material coming from the extraction (not shown), e.g. soybean meal (100) containing approx. 25 to 35% hexane, is heated in the pre-desolventizing stage (120) to the vaporization temperature of the hexane; while the meal passes through the pre-desolventizer, between 58 and 62% of the hexane is vaporized. The vaporized hexane is continuously led off—possibly under a low vacuum—and supplied through (140) to the regeneration unit.

The warm meal still containing approx. 10 to 15% hexane passes in continuous flow from the pre-desolventizer (120) via line (122) to the desolventizer proper or main desolventizer generally designated by (200).

It may be of advantage if the entire line (122) is used for pre-desolventization. As far as is possible, said line (122) should be so insulated and also, possibly, indirectly heated that the temperature of the meal at exit from the pre-desolventizer will be substantially maintained until the entrance into the main desolventizer (200).

The main desolventizer with direct-steam admission (200) which is shown schematically, by way of example only, in FIG. 3 comprises three desolventizing stages (a,b,c) with inserted perforated plates formed as double bottoms, said bottoms being adapted to be supplied with indirect steam as well as with direct steam.

Agitator or rabble arms on a common central shaft (indicated only as the center line of the vessel (200)) move slightly above each bottom, whereby the meal is constantly agitated and turned round.

Below the lowermost bottom of the main desolventization, i.e. underneath the bottom (201) forming the termination of stage (c), direct steam, particularly superheated steam (107) is blown in, the steam, in passing through the bottom (201), being uniformly distributed over the entire cross-sectional area of the main desolventizer (200).

The steam streams through all the compartments or stages (c,b,a) and in doing so desolventizes the meal. Due to the vaporization of the hexane, a portion of the steam being blown in condenses while the rest of the steam, together with the hexane, leaves the disolventizer, as vapors, through (100).

Suitable desolventizing units for the main desolventization and fully continuous operation are described in EP-A-O 070 496 or European Patent Application No. 82 106 498.7 respectively, the mentioned European Patent Application No. 82 106 498.7 relating particularly to a desolventizing unit for direct, superheated steam.

Through a rotary gate valve (104) in the lowermost bottom (201) of the desolventization proper, the hot meal being now free from hexane, but enriched with water up to 22 to 23% by weight—or, in continuous operation, up to 15 to 19% by weight only—passes continuously into the combination of drying and cooling consisting in accordance with the invention of a single unit (stage d). This unit is built up similarly, if not identically, to stages (a,b,c); this means that in (d), too, agitator elements are effective which lie on the common central shaft and are moved over double bottoms which correspond to those of stages (a,b,c). At least the bottom (202) is a perforated bottom so that the cooling medium introduced through connection piece (203) will be uniformly distributed over the entire cross-sectional area of the bottom.

For the combined drying and cooling in only one process stage (d), at first, cold air (primary air) supplied through line (150) is blown in by the blower (151) through connection piece (203) into the space (204) under the distributor bottom (202) and distributed by the bottom (202) onto the warm, but already largely dried meal being moved or agitated in (d). During this process, the meal cools down and passes on through another rotary gate valve (105) in the bottom (202), via line (110), to the final processing or utilization.

The primary air having been warmed up while passing through the warm, largely dry meal in (d) leaves the plant through line (141), passes through a cyclone (140) or similar device for the separating of dust and meal particles and, at an average temperature of 45° to 65° C. (113° to 146° F.), particularly 50° to 60° C. (122° to 140° F.), via the heat exchanger (130), into the atmosphere (135).

In the heat exchanger (130), the warmed-up primary air transmits most of its heat content to new fresh air (131) which, as secondary air, is warmed up thereby to approx. 44° to 64° C. (111° to 147° F.), particularly 50° to 60° F.). The secondary air warmed up in this way passes via line (132) and blower (133) as well as line (134) into the space above the meal bed in stage (d). Here, warm primary air and warm secondary air unite and act on the wet meal falling down through rotary gate valve (104) into stage (d) to dry said meal.

The united air streams escape through line (141), cyclone or dust separator (140) etc. and, after transmitting their heat content to fresh secondary air (131) in the heat exchanger (130), leave the plant via (135).

It is understood that the process derivable from FIG. 3 and the apparatus schematically shown in FIG. 3 have to be regarded as showing only by way of example the scope of the invention and the technical applicability of the invention.

This applies above all to the dimensioning or layout of the apparatus or devices, the interaction thereof, the general operating conditions such as times of sojourn, circulation of air etc. Also, all the elements shown, such as cyclones, dust separators, heat exchangers, blowers etc. are to be adapted to the respective optimal conditions.

The measures of the invention do not only optimize the energy consumption figures in the desolventizing of solvent-wet extraction residues—which is a special result of the pre-desolventizing according to the invention—but make also possible a reduction of the volume of apparatus by the main desolventizing + combined drying and cooling appearing as a unit. Thus, for example, it has been found that the condensate of the indirect steam resulting in the pre-desolventization, used as feed water of the steam boiler, helps to relieve said boiler, that the path between extractor and desolventizing, by the use of a screw conveyor with indirect steam heating or of an equivalent conveyor unit, practically offsets the investments for the pre-desolventizing since that way or path must be moved through in any case.

The pre-desolventizing also makes it possible to reduce the expenditure for the regenerating of the solvent from the main desolventization as the solvent, e.g. hexane, resulting from the pre-desolventization, requires no separation of water.

Finally, the throughput, and consequently the capacity and performance, of desolventizing plants, which is already substantially increased by the pre-desolventizing, is further optimzed by the combined drying and cooling.

I claim:

1. Apparatus for desolventizing residue meal obtained in the extraction of oil and fat from vegetable materials with organic solvents in an extractor after the separation of the oil and fat, said apparatus comprising:

a pre-desolventizer means connected to the extractor for removing a substantial amount of said organic solvents from the residue meal;

a desolventizer having multiple stages for desolventization of residual organic solvents from the residue meal and a final stage having a perforated bottom adapted to provide a dried meal bed for the combined drying and cooling of the residue meal, said desolventizer being connected to said pre-desolventizer means, said pre-desolventizer means providing at least a part of the path along which the residue meal is conveyed from the extractor to said desolventizer;

means for providing indirect steam heating in said pre-desolventizer means; and means for supplying cooling air through the perforated bottom into the final stage of said desolventizer to cool the meal dried in said final stage.

2. The apparatus as claimed in claim 1 further comprising a heat exchanger for indirectly heating fresh air with air removed from the final stage to provide prewarmed fresh air for drying the meal in the final stage.

3. The apparatus as claimed in claim 1 further comprising means for passing condensate formed by the steam that indirectly heats the meal in said pre-desolventizer means to a steam generating means for producing steam.

* * * * *

UNITED STATES PATENT AND TRADEMARK OFFICE

CERTIFICATE OF CORRECTION

PATENT NO. : 4,622,760

DATED : November 18, 1986

INVENTOR(S) : Heinz O. Schumacher

It is certified that error appears in the above-identified patent and that said Letters Patent is hereby corrected as shown below:

(1) Column 3, line 60, delete "formatioh" and substitute therefor --formation--;

(2) Column 10, line 16, change "60° F." to --60° C.--; and (3) Immediately after --60° C.--, above, add --(122 to 140° F.--.

Signed and Sealed this

Seventeenth Day of February, 1987

*Attest:*

DONALD J. QUIGG

*Attesting Officer*

*Commissioner of Patents and Trademarks*